US005360296A

United States Patent [19]

Angelette

[11] Patent Number: 5,360,296

[45] Date of Patent: Nov. 1, 1994

[54] EARTH RETAINING WALL

[76] Inventor: A. M. Angelette, 4160 Ewing Rd., Austell, Ga. 30001

[21] Appl. No.: 872,334

[22] Filed: Apr. 23, 1992

[51] Int. Cl.[5] ..... E02D 29/02

[52] U.S. Cl. ..... 405/285; 405/286

[58] Field of Search ..... 405/279, 284, 285, 286, 405/114; 256/19, 26

[56] References Cited

U.S. PATENT DOCUMENTS

| | | | |
|---|---|---|---|
| 981,749 | 1/1911 | Cluxton | 405/279 X |
| 1,362,852 | 12/1920 | Dabis | 405/285 |
| 2,880,588 | 4/1959 | Moore | 405/285 |
| 3,953,979 | 5/1976 | Kurose | 405/286 |
| 4,193,584 | 3/1980 | Wieser | 256/19 |
| 4,269,545 | 5/1981 | Finney | 405/285 |

*Primary Examiner*—David H. Corbin
*Attorney, Agent, or Firm*—Kennedy & Kennedy

[57] ABSTRACT

A retaining wall 10 comprises an array of juxtaposed piles 11 and precast panels 12 mounted between adjacent piles. Laterally adjacent panels are mounted to each other and to a common pile 11 by links 38 and 39 pivotably mounted at each end to the panels so as to allow the panels to move with respect to each other and to the pile.

9 Claims, 2 Drawing Sheets

EARTH RETAINING WALL

TECHNICAL FIELD

This invention relates to earth retaining walls.

BACKGROUND OF THE INVENTION

Today there exists many types of walls used to retain earth and the like. Some have been constructed by merely vertically stacking and cementing cement blocks or rocks together. This method of construction is costly and time consuming.

Walls have also been constructed by mounting a number of juxtaposed piles in the ground and vertically stacking elongated, horizontal members, such as railroad ties, one atop the other behind the piles. The piles prevent the stack from falling forward as earth is pressed against the rear of the wall. This method has also proven to be a costly and time consuming process. A variation in this method has been the use of preshaped, elongated members such as guard rails which are bent into in the desired shape of the wall. The preshaped members are stacked one atop the other in constructing the wall. The preshaping of the members however has limited the adaptability of the wall to particular sites and increased costs due to their lack in design versatility.

In recent years retaining walls have been made of precast, interlocking, concrete panels. However, because these panels are interlocked stresses exerted on them as adjacent earth settles causes them to weaken and break as they move relative to each other. Additionally, these types of walls are typically provided with anchors which must be buried in the ground behind the wall to prevent the wall from falling forward. The cost of these anchors and of their installation increases costs and construction time.

Accordingly, it is seen that a need remains for a wall for retaining earth in a more cost efficient and durable manner. It is to the provision of such therefore that the present invention is primarily directed.

SUMMARY OF THE INVENTION

In a preferred form of the invention, an earth retaining wall comprises at least one pile preferably of the type that has a pair of bars oriented generally normal to each other in a T-shaped or L-shaped configuration. A pair of panels is positioned uprightly with an end of each panel closely adjacent each other and the pile. The panels are coupled together with links that are pivotably mounted at one end to one panel and pivotably mounted at their other end to the other panel spanning the pile so as to allow limited relative movement of the panels along the pile as adjacent earth settles and shifts.

DETAILED DESCRIPTION

Figure 1:
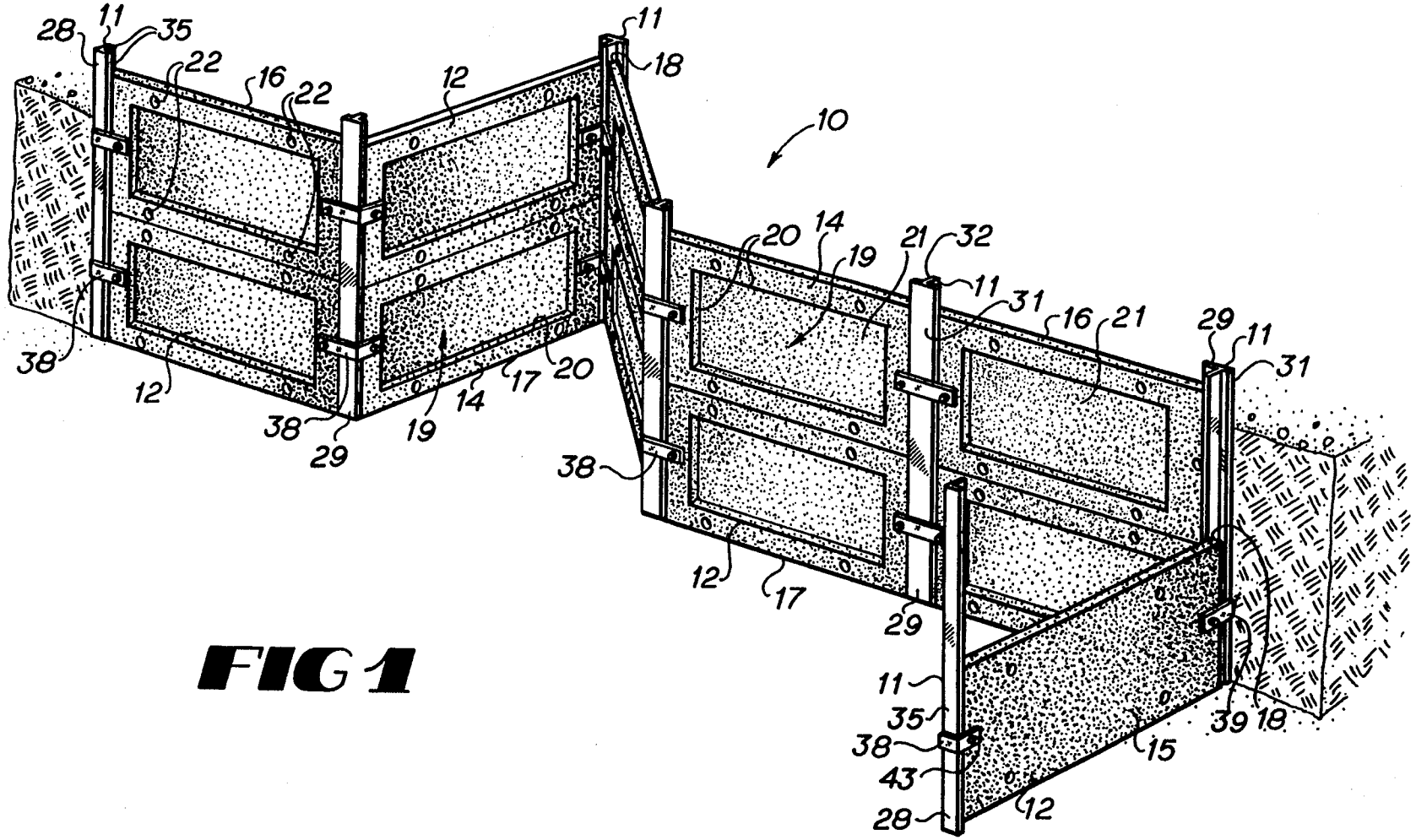
FIG. 1 is a perspective view of a retaining wall that embodies principles of the invention in a preferred form.

With reference next to the drawing, there is shown in FIG. 1 a retaining wall 10 having seven steel piles 11 mounted uprightly in the ground and eleven precast concrete panels 12 mounted uprightly to the piles 11 and to each other. Each panel 12 has a front side 14, a back side 15, a top end 16, a bottom end 17 and two side ends 18. The front side 14 has a recess 19 defined by a recess floor 21 and perimetral recess walls 20 which are oriented approximately 45° to the front side 14 and recess floor 21. Each panel has four side holes 22 and two end holes 23 extending completely through the panel. Each hole has a plastic sleeve 24 mounted therein.

The piles 11 located on the ends of the wall 10 are generally L-shaped angle iron type piles 28 while the intermediate piles located between adjacent panels 12 are generally T-shaped or T-bar type piles 29. The T-shaped piles 29 have a face bar 31 and a center bar 32 extending generally normal from a mid portion of the face bar 31. The L-shaped piles 28 have two side bars 35 oriented generally normal to each other.

The panels 12 are retained generally in position by outer links 38 and inner links 39. Each link is rigid and has an elongated slot 40 adjacent each of its ends. A threaded bolt 42 extends through each slot 40 of the outer link 38, through the sleeve 24 of a panel hole 22 or 23, and through each slot 40 of the inner link 39. A nut 43 is threaded fairly tightly onto each bolt end.

Figures 2, 3, 4:
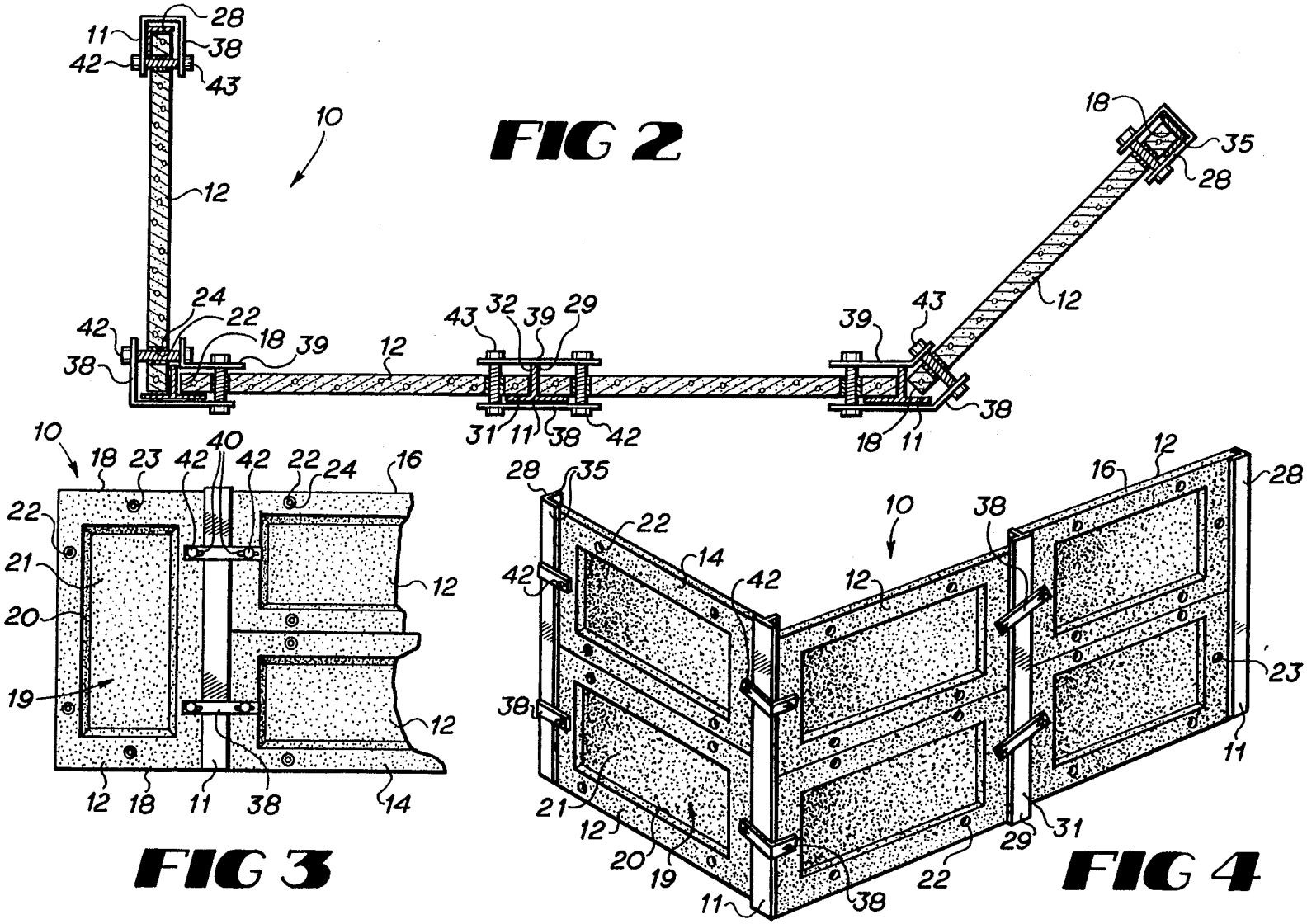
FIG. 2 is a top view of a retaining wall that also embodies principles of the invention.
FIG. 3 is a front elevational view of a portion of another variation of the retaining wall of the present invention.
FIG. 4 is a perspective view of the retaining wall of the invention shown in yet another configuration.

To erect the retaining wall 10 the piles 11 are first driven into the ground at distances slightly greater than the length of a panel. As best shown in FIG. 2, two end member of panels 12 are positioned uprightly between an L-shaped pile 28 and an adjacent T-shaped pile 29. One side end 18 of each panel is positioned between the side bars 38 of the L-shaped pile 28 while the other side end 18 is positioned between the center bar 32 and the face bar 31 of the T-shaped pile 29. The panel is secured to the L-shaped pile by pivotably mounting an outer link 38, formed into the shape of a U, to the panel and about the L-shaped pile 28. This is done by extending a bolt 42 through the link slot 40 adjacent the panel front side 14, the sleeved panel end hole 23, and the link slot 40 adjacent the panel back side 15 and threaded a nut 43 onto the bolt end.

Next, another panel 12 is positioned between the T-shaped pile 29 adjacent the first panel and the next successive T-shaped pile 29. The panel is positioned so that each of its end walls 18 is located between the center bar 32 and the face bar 31 of a T-shaped piles. The two adjacent panels are then mounted to each other and to the pile positioned therebetween by pivotably mounting the ends of the outer and inner links 38 and 39 to each panel. This is done by extending the bolts 42 through slots 40 of the outer link 38, the sleeved end holes 23 of the panels, and the slot 40 of the inner link 39 and then threading nuts 43 onto the bolt ends. In turn the other bottom panels of the wall are positioned and mounted in the just described manners. Once the bottom panels are mounted upper panels may be stacked upon them and mounted to each other and to the piles in the manners just described. The wall may alternatively be constructed one section at a time along the entire length of the wall by successively forming vertical stacks of panels.

As shown in FIG. 3, the retaining wall may include panels with their longer side oriented vertically instead of horizontally. When oriented vertically the side holes 22 of the panel are located at substantially the same level as the end holes 18 of a horizontal panel. The vertical panel may be coupled to one or more horizontal panels as previously described except that bolts 42 extend through the vertical panel's side holes 22 rather than its end holes 23. A vertical orientation of a panel may be preferred when the width of a section of the wall between two piles is equal to or less than some two feet.

The wall may be constructed with laterally adjacent panels oriented at various acute and obtuse angles to each other as shown in both FIGS. 1 and 2. In such cases, the outer and inner links 38 and 39 are bent or contoured to conform substantially to the angle between the panels.

As best shown in FIG. 4, the new earth retaining walls may have panels initially mounted at somewhat different levels as where the terrain is sloping. Also, with this wall construction individual panels or individual stacks of panels may vertically shift over time as the adjacent earth settles and shifts without adversely effecting the integrity of the wall. This important characteristic of the wall is attributed to the panels being movably mounted to adjacent panels and piles. Each panel or panel stack may therefore shift without disturbing or effecting the positioning of the laterally adjacent panels or piles. Where this occurs an entire stack will normally settle as a unit without a gap being created between the panel members of the stack.

Several factors contribute to the movability of the panels. One design factor is the elongated slots which allow the panel bolts to shift therein. This, in combination with the pivotable mounting of the links, allows the panels to move horizontally or vertically for a limited distance. Lateral spacial tolerance during mounting or afterwards as the earth settles and shifts, also does not create gaps in the walls as the piles themselves still provide wall continuity. The sleeves of the panel holes 22 and 23 have an inside diameter approximately ¼ of an inch larger than the outside diameter of the shaft of the bolt 42. This also allows the panels to move slightly without moving the links. Note that panels holes 22 and 23 which are not occupied by bolts 42 function as weep holes.

It should be understood that the retaining wall may be constructed of piles formed of a single bar. However, such is not recommended since multiple bar piles, and especially the T-shaped piles, have greater in ground stability.

It thus is seen that a new retaining wall is now provided that overcomes problems long associated with those of the prior art. Though the wall has herein been shown 10 for use in retaining earth, it may, or course, be used in other applications. It should be understood that many modifications, additions and deletions may be made to the preferred embodiment that has been illustrated and described without departure from the spirit and scope of the invention as set forth in the following claims.

I claim:

1. An earth retaining wall comprising at least one pile, two panels positioned uprightly with an end of each of said panels positioned closely adjacent said pile and each other, and means for holding said panel ends together for limited relative movement along said pile which comprises a link pivotably mounted to said panel ends spanning said pile.

2. The retaining wall of claim 1 wherein said link is mounted over one side of said pile, wherein said holding means comprises another link pivotably mounted to said panel ends over a side of said pile opposite said one side.

3. The retaining wall of claim 2 wherein said link and said other link are also mounted to each other.

4. The retaining wall of claim 1 wherein said link has two elongated slots extending therethrough and said holding means comprises fastening means that extend through each of said slots.

5. The retaining wall of claim 4 wherein said fastening means comprises a pair of bolts and nuts.

6. The retaining wall of claim 5 wherein said panels are substantially rectangular with one pair of opposite sides being substantially longer than another pair of opposite sides and with said pairs of sides merging at four panel corners, and wherein said panels have at least one mounting hole located adjacent each of said panel sides substantially equidistant from an adjacent panel corner, whereby a mounting hole of an upright panel oriented horizontally is substantially level with a mounting hole of an adjacent upright panel oriented vertically or horizontally, and whereby mounting holes not occupied by the bolts may function as weep holes.

7. The retaining wall of claim 1 wherein said pile is T-shaped.

8. The retaining wall of claim 1 wherein said pile is L-shaped.

9. The retaining wall of claim 1 wherein said pile is formed of steel and each of said panels is formed of precast concrete.

* * * * *